US005435705A

United States Patent [19]

Heng

[11] Patent Number: 5,435,705

[45] Date of Patent: Jul. 25, 1995

[54] DRIVING APPARATUS FOR A WOBBLE PLATE MACHINE

[75] Inventor: Thomas Heng, Worms, Germany

[73] Assignee: KSB Aktiengesellschaft, Frankenthal, Germany

[21] Appl. No.: 267,281

[22] Filed: Jun. 28, 1994

[30] Foreign Application Priority Data

Jul. 2, 1993 [DE] Germany ..... 43 22 077.0

[51] Int. Cl.[6] ..... F04C 9/00

[52] U.S. Cl. ..... 418/53; 418/182

[58] Field of Search ..... 418/53, 52, 182; 464/106, 147, 157

[56] References Cited

U.S. PATENT DOCUMENTS 2,475,096 7/1949 Holl .

FOREIGN PATENT DOCUMENTS 0341903 1/1904 France ..... 418/53
997334 7/1945 France .
166879 3/1883 Germany .
1090966 10/1954 Germany .
1277673 11/1965 Germany .
1551082 5/1970 Germany ..... 418/53
511776 2/1938 United Kingdom .
874838 11/1957 United Kingdom .
988282 1/1962 United Kingdom .

*Primary Examiner*—Richard A. Bertsch
*Assistant Examiner*—Charles G. Freay
*Attorney, Agent, or Firm*—Darby & Darby

[57] ABSTRACT

A drive apparatus for a wobble plate machine includes a transport chamber having at least two side walls. A wobble plate is disposed in the transport chamber and abuts at least one of the side walls to form a seal and to divide the transport chamber into two mutually independent transport chambers. A wobble plate shaft is connected to the wobble plate to move the wobble plate about a wobble point. A drive shaft is drivingly connected to the wobble plate shaft. The wobble plate shaft is disposed at an angle with respect to the drive shaft. The connection between the drive shaft and the wobble plate shaft is moveable by a spring so that the angle may vary to a largest possible angle. The spring is supported by the wobble plate shaft and the drive shaft.

6 Claims, 4 Drawing Sheets

DRIVING APPARATUS FOR A WOBBLE PLATE MACHINE

FIELD OF THE INVENTION

The present invention relates to a driving apparatus for a wobble plate machine. More specifically, the present invention relates to a wobble plate that makes a section-by-section contact with the side walls of a transport chamber and abuts the side walls to form a seal. Thus, mutually independent transport chambers are formed on either side of the wobble plate. Additionally, the wobble plate is moved about a wobble point by a wobble plate shaft that is disposed at an angle to the drive shaft.

BACKGROUND OF THE INVENTION

A wobble plate machine functions according to the following principle: When a drive shaft rotates, a wobble plate shaft is caused to move so as to describe a cone about the center axis of the drive shaft. Because the wobble plate shaft is inclined with respect to the center axis of the drive shaft, a wobble plate positioned perpendicular to the wobble plate shaft executes a wobbling motion about a wobble point disposed on the center axis of the drive shaft. A separation web which penetrates the wobble plate and which extends in the axial direction of the drive shaft divides the transport chamber into a suction-side part and a pressure-side part. The wobble plate moves along the side walls of the transport chamber and creates two circumferential transport chambers of variable capacity within the transport chamber. Ideally, the wobble plate contacts the side walls of the transport chamber in sections.

DE-AS 1 090 966 discloses a wobble plate pump, in which the wobble plate is disposed in a transport chamber. Those housing walls of the transport chamber which are disposed opposite the wobble plate are cone-shaped. The plane of the transport chamber is perpendicular to the plane of the drive shaft. The wobble plate is disposed in the transport chamber at an angle, and thus transport chambers, with a variable capacity, are formed on both sides of the wobble plate. When the wobble plate moves in the transport chamber it has the shape of a circular ring whose inside diameter is disposed on a spherical surface of a wobble plate hub. This spherical surface is mounted in appropriately shaped counter-surfaces of the pump housing which encloses the transport chamber.

The wobble plate shaft is mounted in a rotor that is connected to the drive shaft. For this purpose, the rotor has an eccentric bore, positioned at an angle to the center axis of the drive shaft. Two ball bearings are disposed in this bore. Their outer ball races contact the wall of the bore and guide one end of the wobble plate shaft. When the rotor turns, the end of the wobble plate shaft describes a circle about the center axis of the drive shaft, and the wobble plate executes a wobbling motion about the wobble point.

Another driving apparatus is described in the DE-PS 12 77 673. To achieve wobbling motion, the drive axle has an angled section which describes a uniform double cone when the drive shaft rotates. The center of the double cone is the wobble point. Through a needle bearing, a hub is supported on the angled section, to which the wobble plate is connected.

In both of these designs, one difficulty is that the wobble plate shaft must be guided so that the wobble plate contacts the side walls of the transport chamber as well as possible during the entire rotation. However, if there are even the slightest deviations from the calculated ideal dimensions, for example due to inaccuracies of the wall surfaces, distortion of parts through heat expansion or through rolling over foreign bodies, then the wobble plate will not be positioned in the desired angled position. As a result, the wobble plate either is pressed too strongly against the side walls or else high forces arise from the distortions. Such forces could destroy the wobble plate machine and the driving motor. Another risk is the creation of a gap between the wobble plate and the side walls, which would reduce efficiency of the wobble plate machine.

It is therefore an object of the invention to bring the wobble plate into contact with the side walls of the transport chamber in such a way that, when the wobble plate machine is operated, proper contact is obtained and maintained, so that the gap losses will be small and distortions are avoided.

SUMMARY OF THE INVENTION

According to the present invention, the wobble plate shaft is movably connected to the drive shaft so that the wobble plate can change its angled position and is driven to make an excursion into the position of the greatest possible slant by one or more spring elements which are supported, on the one hand, at the wobble plate shaft and, on the other hand, at the drive shaft.

By using an elastic spring element for the excursion of the wobble plate shaft and for achieving the largest possible but flexible shaft angle, the present invention avoids the disadvantage of a rigid drive train having a rigid shaft angle for the wobble plate shaft. In addition, because of its flexibility, the spring element makes it possible to compensate for dimensional deviations and to permit the rolling over of small foreign bodies, without creating high forces or distortions.

In further development of the present invention, the drive shaft is connected to the wobble plate shaft through an articulated joint. The spring element extends over the articulated joint and is positioned essentially parallel to the drive shaft. The torque from the drive shaft is transferred, via the articulated joint, to the wobble plate shaft. The wobble point of the wobble plate lies on the articulation line of the articulated joint.

To eliminate the risk of the wobble plate twisting and of the wobble plate running against the separation web, further developments of the present invention disclose an apparatus for connecting these components in a rotationally rigid manner. This apparatus is disposed between the mutating wobble plate hub and the stationary housing or drive-shaft guide. Such a connection can be implemented, e.g. , by mutually engaging gear wheels or by a rotationally rigid bellows, with one being made of metal.

Further development of the present invention provides for a radially movable bearing part for mounting the wobble plate shaft in the drive shaft, such that the bearing part makes a radial excursion under the action of a spring element that is disposed essentially perpendicular to the drive shaft. A guide of the bearing part in the radial direction prevents the bearing part from escaping under an elevated driving force. If the positive-locking connection is made by a groove and a bolt, where it basically makes no difference which part has the groove and which has the bolt, the bearing part can also be turned about the center axis of the bolts. Additionally, designing the groove in the shape of an L facilitates assembly of the drive train.

The present invention can also be used advantageously for wobble plate pumps, but it can also be used for wobble plate machines that operate as turbines, for example, to measure the flow through the device.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENT INVENTION

Figure 1:
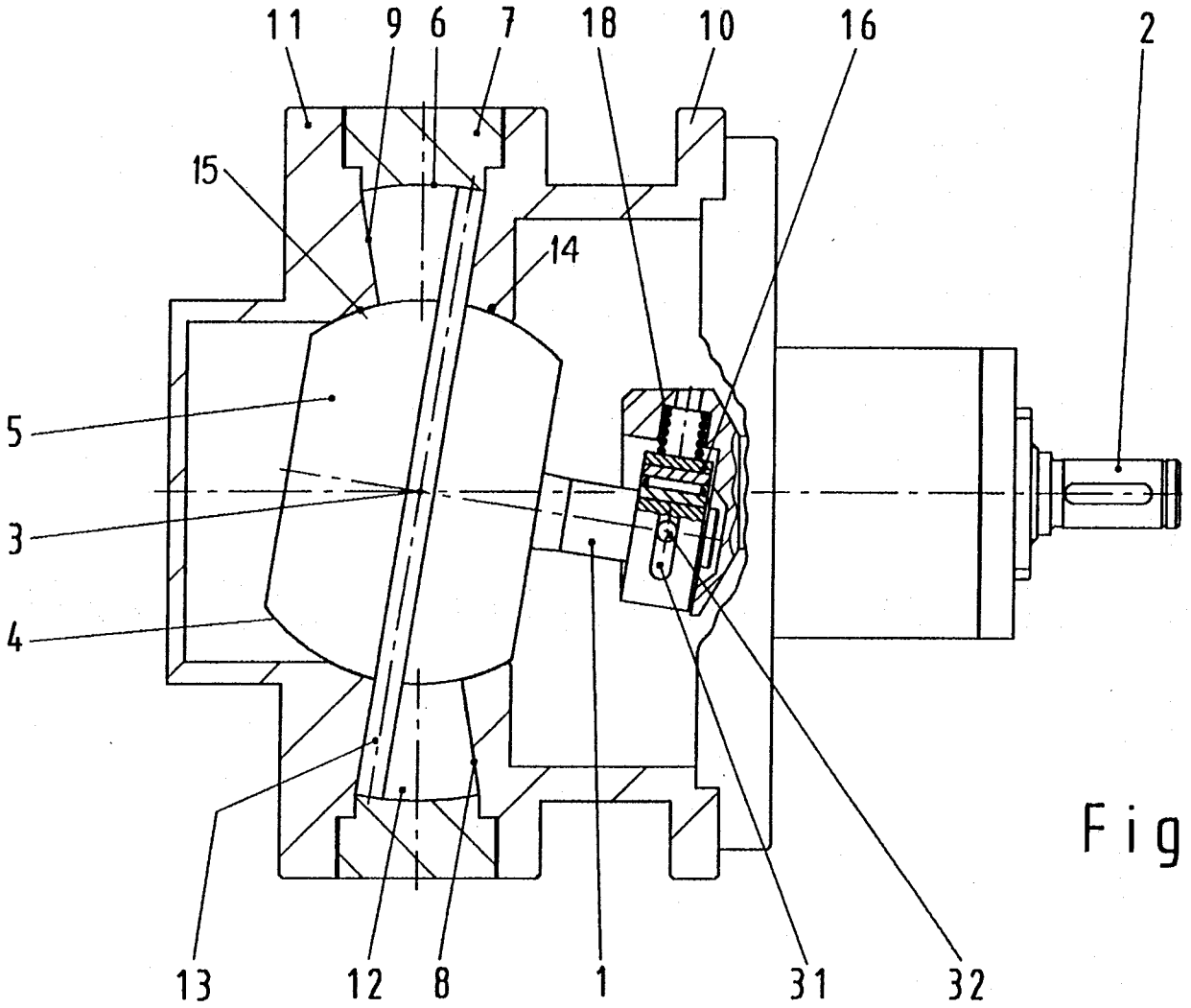
FIG. 1 shows a driving apparatus for a wobble plate pump with a drive train including a wobble plate shaft mounted in the drive shaft.

Referring now to FIG. 1, a wobble plate pump is illustrated. A wobble plate shaft 1 is actuated by a drive shaft 2 about a wobble point 3 so as to describe a double-cone or conical surface. The wobble point 3 coincides with the center point of the spherical surface 4 of the wobble plate hub 5 and of the spherical inner surface 6 of a ring 7. These surfaces, together with the conical side walls 8, 9 of a first side part 10 disposed on the drive side and of a second side part 11, bound a transport chamber 12. This transport chamber 12, which may be a pumping chamber, contains a wobble plate 13, which is seated on the spherical surface 4 of the wobble plate hub 5, and is moved in the transport chamber 12 through the wobble plate shaft 1. The first side part 10, which is disposed on the drive side, has a central opening for the wobble plate shaft 1.

The wobble plate shaft 1 can be connected to the wobble plate hub 5 in many different ways, e.g. by welding, threaded fasteners or the like. Of course, to achieve the greatest possible precision, the wobble plate hub 5 can be made of one piece. However, a structure composed of several parts is also possible. To achieve a dynamic seal, the outer edge of the wobble plate 13 preferably has a contour corresponding to the spherical inner surface 6. The transport chamber 12 is sealed against the inner chamber of the pump by a dynamic seal between the spherical surface 4 and the corresponding spherical surfaces 14, 15 of the side parts 10, 11. At the same time, the wobble plate hub 5 can also be mounted at these points.

Figure 3:
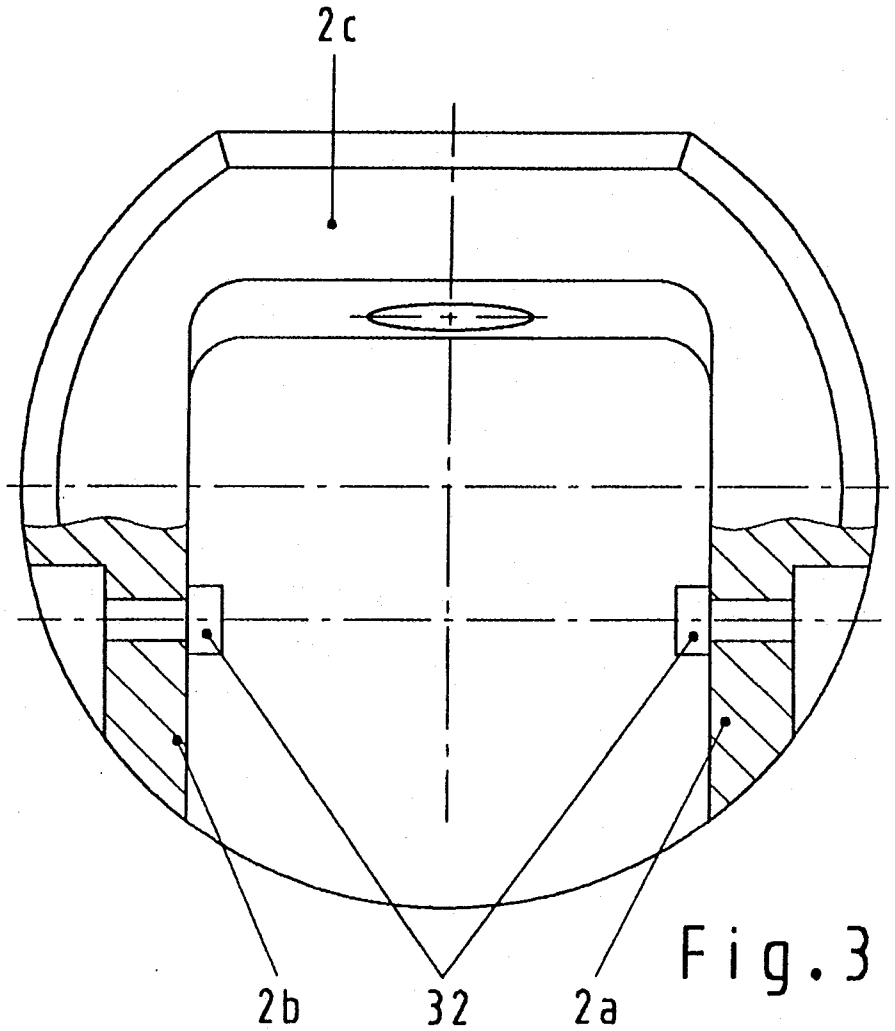
FIG. 3 shows a magnified frontal view of the drive shaft.
Figure 2:
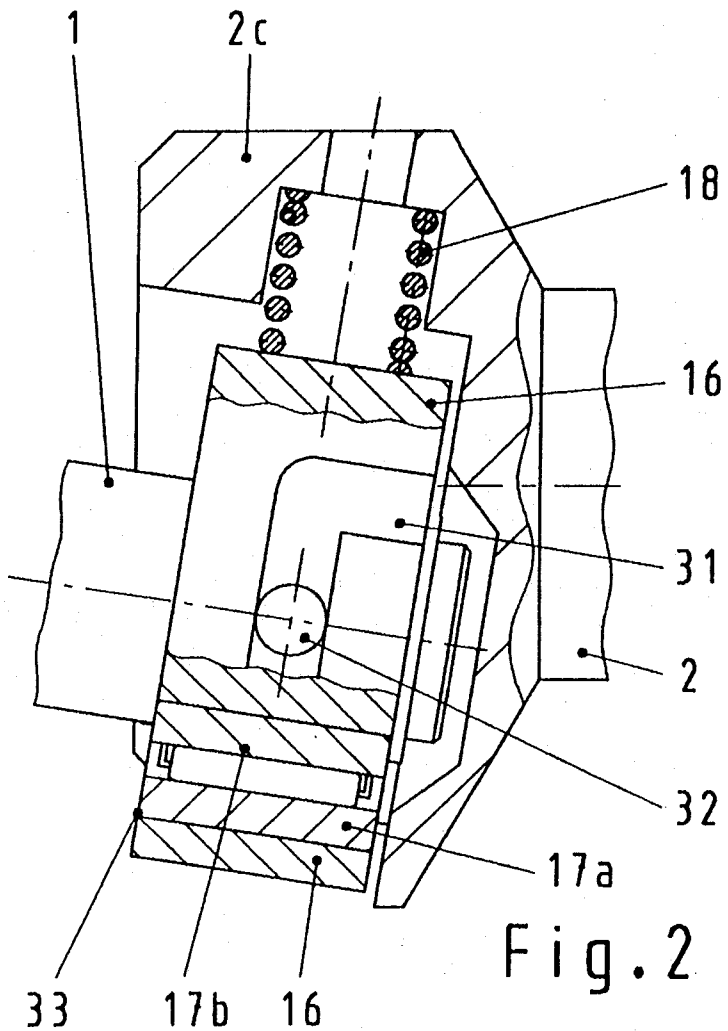
FIG. 2 shows a magnified sectional view of the drive train.

One end of the wobble plate shaft 1 is guided, by a bearing, in a part 16 disposed at the end of the drive shaft 2. FIGS. 2 and 3 show a magnified sectional view of the drive train. The outer ball race 17*a* of the bearing is disposed in the bearing part 16; the inner ball race 17*b* is disposed on the wobble plate shaft 1. The bearing part 16 is guided laterally and can be moved in the radial direction in the manner of a slide. To transfer the torque, the bearing part 16 is laterally supported against the side walls 2*a*, 2*b* of the drive shaft 2.

A pre-tensioned spring element 18 is disposed at the end of the drive shaft 2 between the bearing part 16 and a support wall 2*c* disposed between the side walls 2*a*, 2*b*. This spring element 18 guides the bearing part 16 radially outward into a position of maximum eccentricity. The bearing part 16 is flattened at the contact surface of the spring element 18. In this embodiment, the spring element 18 is disposed perpendicular to the wobble plate shaft 1, but the present invention,is not limited to this arrangement. Since the driving torque is transferred, in a direction perpendicular to the direction in which the spring element 18 acts, on the bearing part 16, which is retained in the drive shaft 2, high driving torques can be transferred.

The bearing part 16 is essentially disposed perpendicularly to the center axis of the wobble plate shaft 1. If the slant position of the wobble plate shaft about the wobble point 3 changes, the position of the bearing part 16 must change so that the drive train will remain free of distortions. Using a roller bearing to guide the wobble plate shaft 1 in the bearing part 16 makes it possible to equalize of the wobble plate shaft 1 in the axial direction. To further make the angular equalization of the bearing part 16, at each of its side wall, possible, the bearing part 16 has a groove 31 disposed on that side which is opposite to the side walls 2*a*, 2*b*. A bolt 32 disposed in the side walls 2*a*, 2*b* engages this groove and serves as a rotary bearing.

The bolt 32 is placed into the side walls 2*a*, 2*b* from the inside. Bolt 32 has a head portion which is wider than its shaft portion. When the bearing part 16 is mounted, the loosely inserted bolt 32 is secured. No additional screw-connection is necessary. With the bolt 32, the bearing part 16 has two degrees of freedom of motion. The groove 31 is L-shaped. The groove 31 is disposed on the bearing part side walls so that there is a space at an upper edge and at a lower edge thereof. The L is open in a direction opposite to a face of the bearing part, in the direction toward the drive shaft (see FIG. 2).

In a modification of the present invention, the bearing part 16 has bolts which engage a groove in the side walls 2*a*, 2*b* (not shown). This modification would have the advantage that the rotational axis of the bearing part 16 does not change relative to the wobble plate shaft 1 when the latter makes a radial excursion.

The operation of the driving apparatus of the present invention is described below. The rotation of the drive shaft 2 guides that end of the wobble plate shaft 1 which is mounted in the bearing part 16 along a circular track about the center axis of the drive shaft 2. The wobble plate shaft 1 wobbles about the wobble point 3 without itself turning about its own center axis. Here, the casing surface describes a double cone, whose common tip lies at the wobble point 3. The wobble plate 13 is disposed perpendicular to the wobble plate shaft 1, and its side surfaces roll off the side walls 8, 9 of the transport chamber 12. The slant position is here limited by the contact of the wobble plate with the side walls 8, 9 of the transport chamber 12. Because of the spring element 18, the wobble plate 13 can roll off the side walls 8, 9 free of distortions, even if it rolls over small irregularities.

Rolling over a foreign body has the following effect: The wobble plate 5 lifts off from one of the side walls 8, 9, thus reducing the slant position of the wobble plate shaft 1. The reduction of the slant position reduces the radial excursion of that end of the wobble plate shaft 1 which is guided in the bearing part 16, and the bearing part 16 is pressed toward the support wall *2c*, counter to the spring force of the spring element 18. Thus, small mechanical deviations of the components themselves are also compensated without distortion.

Figure 4:
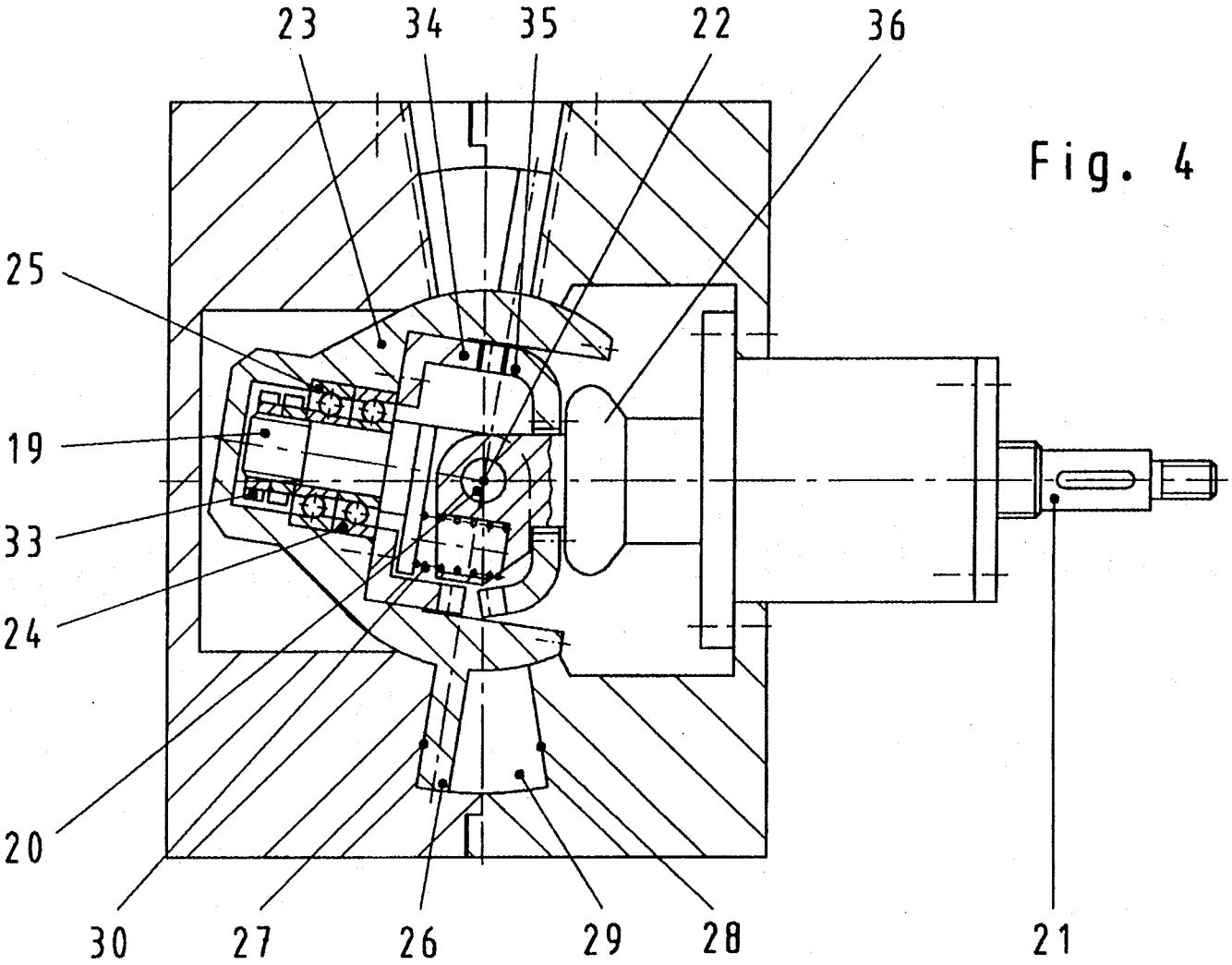
FIG. 4 shows a driving apparatus for a wobble plate pump having an articulated Joint.

FIG. 4 illustrates another embodiment of the present invention. The wobble plate shaft 19 is connected in a rotationally rigid manner to the drive shaft 21 by means of an articulated joint 20 which turns with drive shaft 21. The articulation axis of the articulation point passes through the wobble point 22. The wobble plate shaft 19 is mounted in a wobble plate hub 23 by means of ball bearings 24, 25. The ball bearings 24, 25 are held on the wobble plate shaft 19 by means of shaft nuts 33. When the drive shaft 21 turns, the wobble plate-shaft 19 describes the surface of a cone with a tip at the wobble point 22, and the wobble plate hub 23 wobbles about the wobble point 22. A wobble plate 26, standing vertically on the wobble plate hub 23, and moving over the wobble plate shaft 19, is pressed against the side walls 27, 28 of the pump chamber 29 by a spring element 30, which extends longitudinally over the articulated joint. Other types of springs can also be used as the spring element 30 to produce the articulation, for example a hair-pin spring may be used. For rolling over foreign bodies or to compensate for mechanical inaccuracies, the wobble plate 26 can lift off from the side walls 27, 28 counter to the spring force of the spring element 30.

Figure 5:
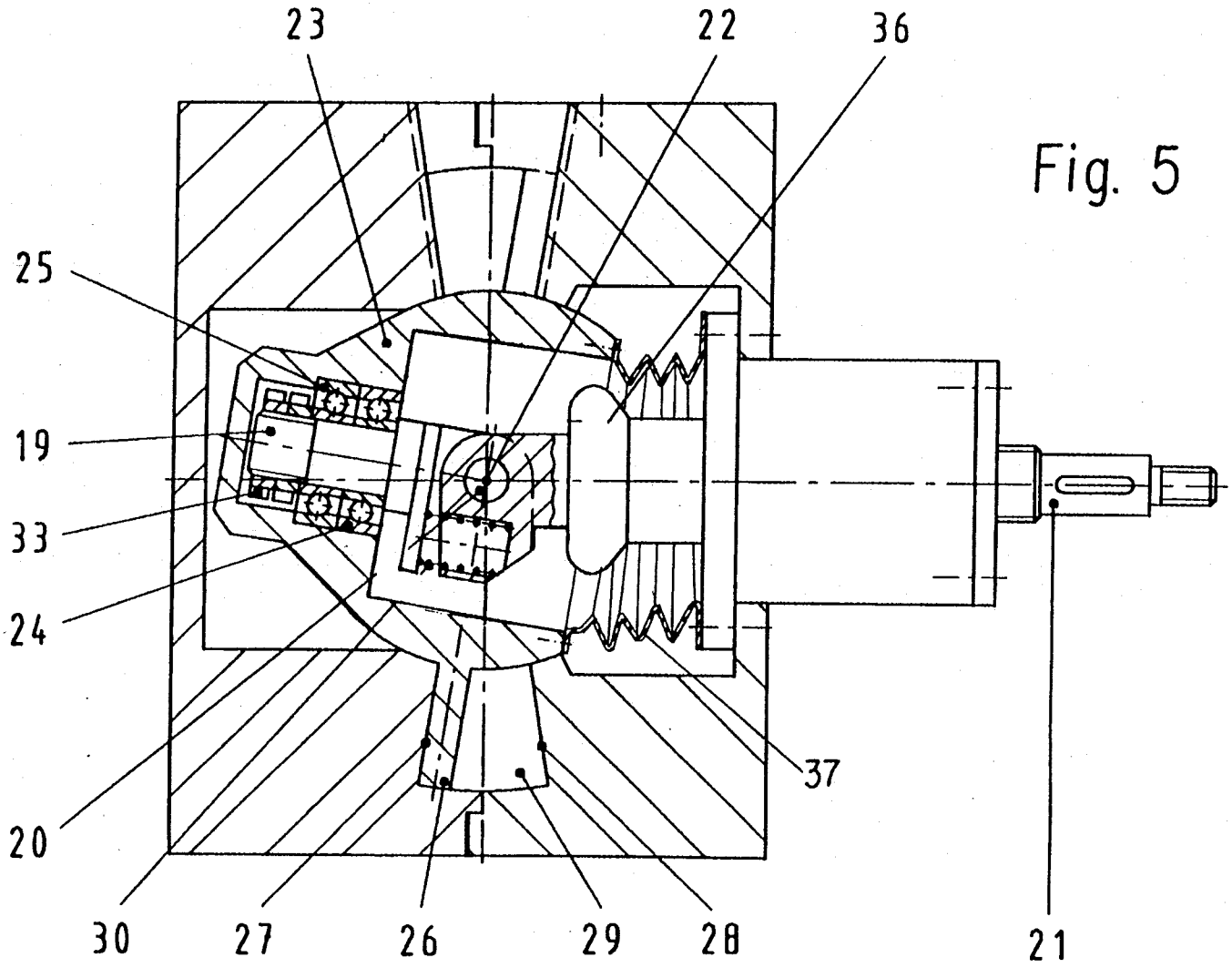
FIG. 5 shows a driving apparatus similar to FIG. 4 except a rotationally rigid bellows is shown in place of a toothed ring.

To prevent the wobble plate 26 from twisting about the center axis of the drive shaft 21, the wobble plate hub 23 and a drive-shaft guide 36 are supported against one another through the teeth of a toothed ring 34, which is connected to the wobble plate hub 23, and through the teeth of a toothed ring 35 that is connected to the drive-shaft guide 36 or to the housing of the wobble plate machine. The toothed rings 34, 35, are disposed at a slant to one another, and always engage only partially. Twisting can also be prevented by using a rotationally rigid bellows 37 (see FIGS. 1 and 5).

When the wobble plate machine is in operation, the wobble plate 13, 26 contacts the side walls 8, 9 and 27, 28 of the transport chamber 12, 29.

From the foregoing description, it will be appreciated that the present invention makes available, a compact, cost efficient driving apparatus for a wobble plate machine. Having described the presently preferred exemplary embodiment of a new and improved driving apparatus for a wobble plate machine, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

I claim:

1. A drive apparatus for a wobble plate machine comprising:

a transport chamber having at least two side walls;

a wobble plate being disposed in said transport chamber and abutting at least one of said side walls to form a seal and to divide said transport chamber into two mutually independent transport chambers, a wobble plate shaft being connected to said wobble plate to move said wobble plate about a wobble point;

a drive shaft being drivingly connected to said wobble plate shaft in a rotationally rigid manner, by an articulated joint, said wobble plate shaft being disposed at an angle with respect to said drive shaft, said connection between said drive shaft and said wobble plate shaft being moveable by a spring so that said angle may vary to a largest possible angle, said spring being supported by said wobble plate shaft and said drive shaft.

2. The driving apparatus of claim 1, wherein a wobble plate hub and one of a housing of the wobble plate machine and a fixed drive shaft guide are supported against one another to prevent twisting.

3. The driving apparatus of claim 2, wherein the wobble plate hub has a first toothed ring, and one of the drive-shaft guide and the housing has a second toothed ring, which are disposed at an angle with respect to one another.

4. The driving apparatus of claim 2, wherein the wobble plate hub is supported at one of the housing and the drive-shaft guide by a rotationally rigid bellows.

5. A drive apparatus for a wobble plate machine comprising:

a transport chamber having at least two side walls;

a wobble plate being disposed in said transport chamber and abutting at least one of said side walls to form a seal and to divide said transport chamber into two mutually independent transport chambers, a wobble plate shaft being connected to said wobble plate to move said wobble plate about a wobble point;

a drive shaft being drivingly connected to said wobble plate shaft, said wobble plate shaft being disposed at an angle with respect to said drive shaft, said connection between said drive shaft and said wobble plate shaft being moveable by a spring so that said angle may vary to a largest possible angle, said spring being supported by said wobble plate shaft and said drive shaft, wherein an end of the wobble plate shaft is mounted in a bearing part at an end of the drive shaft, such that the bearing part is connected to the drive shaft so as to be movable in a radial direction but fixed in the direction of a rotational motion of said drive shaft, the spring being disposed between the bearing part and the drive shaft, wherein the bearing part is guided in the radial direction through an interlocking connection between a pair of side walls at the end of the drive shaft and an opposing surface of the bearing part, and wherein the side walls said bearing part each have a groove, which extends essentially in a direction perpendicular to a center axis of the wobble plate shaft, and wherein at least one of the bearing part side walls receives a bolt, which engages with the groove.

6. The driving apparatus of claim 5, wherein the groove has the shape of an L and is disposed on the bearing part side walls so that there is a space at an upper edge and at a lower edge, the L being open in a direction opposite to a face surface of the bearing part.

* * * * *